US005253421A

United States Patent [19]

Landmark

[11] Patent Number: 5,253,421

[45] Date of Patent: Oct. 19, 1993

[54] CIRCLE DRAWING KIT APPARATUS

[76] Inventor: Ake Landmark, Gamla Vagen 13, Hallsberg, Sweden, 69400

[21] Appl. No.: 786,918

[22] Filed: Oct. 31, 1991

[51] Int. Cl.[5] ..... B43L 9/04

[52] U.S. Cl. ..... 33/27.03; 33/760; 33/768

[58] Field of Search ..... 33/27.03, 758, 760, 33/767, 768, 770

[56] References Cited

U.S. PATENT DOCUMENTS

| | | | |
|---|---|---|---|
| 577,472 | 2/1897 | White | 33/27.03 |
| 1,045,300 | 11/1912 | Lary | 33/27.03 |
| 2,065,143 | 12/1936 | Metcalf | 33/760 |
| 2,400,343 | 5/1946 | Eskil | 33/27.03 |
| 2,581,858 | 1/1952 | Hilt et al. | 33/27.03 |
| 2,607,990 | 8/1952 | Payamps | 33/27.03 |
| 2,651,843 | 9/1953 | Goodford | 33/27.03 |
| 3,120,059 | 2/1964 | Quenot | 33/27.03 |
| 3,269,015 | 8/1966 | Barker | 33/767 |
| 3,292,262 | 12/1966 | Moll | 33/27.03 |
| 5,063,679 | 11/1991 | Schwandt | 33/370 |

*Primary Examiner*—Thomas B. Will
*Attorney, Agent, or Firm*—Hugh E. Smith

[57] ABSTRACT

A drawing kit includes a base member formed of a ferromagnetic or alternative base member to provide for suction, projection, and the like to an underlying surface, wherein the base member includes a rotatable cylindrical mount, including a diametrically directed through-extending slot to receive a measuring tape housing thereon that extensively and retractably contains a measuring web, wherein the measuring web includes an aperture directed through and adjacent a forward distal end of the web to receive a writing instrument orthogonally through the web to permit scribing of a circular path to an underlying surface.

1 Claim, 4 Drawing Sheets

CIRCLE DRAWING KIT APPARATUS

BACKGROUND OF THE INVENTION

1. Field of the Invention

The field of invention relates to circle drawing apparatus, and more particularly pertains to a new and improved circle drawing kit apparatus wherein the same arranges a multiple of base members arranged for securing of a measuring tape housing relative to an underlying surface to be scribed.

2. Description of the Prior Art

Various writing instruments are available in association with structure to effect the scribing of a circular pattern to a support surface. Such apparatus is exemplified in U.S. Pat. No. 3,491,448 to Quinton, et al. wherein a compass roller permits projection of a pivot point relative to a marker that are longitudinally aligned relative to one another through the roller structure.

U.S. Pat. No. 4,624,057 to Hursey sets forth a template for circles wherein a template structure formed as a plate includes a multiple of apertures to provide for various circular arcs to be directed to an underlying surface.

U.S. Pat. No. 4,530,156 to Kettlestrings sets forth a circle drawing instrument permitting a rotatable disc, including an access opening offset from a center point in a rotatable manner to provide for scribing underlying circles.

As such, it may be appreciated that there continues to be a need for a new and improved circle drawing kit apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of circle drawing apparatus now present in the prior art, the present invention provides a circle drawing kit apparatus wherein the same is arranged for mounting to an underlying support surface to permit the scribing an underlying circle pattern. As such, the general purpose of the present invention, which will be described subsequently in greater detail, is to provide a new and improved circle drawing kit apparatus which has all the advantages of the prior art circle drawing apparatus and none of the disadvantages.

To attain this, the present invention provides a drawing kit including a base member formed of a ferromagnetic or alternative base member to provide for suction, projection, and the like to an underlying surface, wherein the base member includes a rotatable cylindrical mount, including a diametrically directed through-extending slot to receive a measuring tape housing thereon that extensively and retractably contains a measuring web, wherein the measuring web includes an aperture directed through and adjacent a forward distal end of the web to receive a writing instrument orthogonally through the web to permit scribing of a circular path to an underlying surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved circle drawing kit apparatus which has all the advantages of the prior art circle drawing apparatus and none of the disadvantages.

It is another object of the present invention to provide a new and improved circle drawing kit apparatus which may be easily and efficiently manufactured and marketed.

It is a further object of the present invention to provide a new and improved circle drawing kit apparatus which is of a durable and reliable construction.

An even further object of the present invention is to provide a new and improved circle drawing kit apparatus which is susceptible of a low cost of manufacture with regard to both materials and labor, and which accordingly is then susceptible of low prices of sale to the consuming public, thereby making such circle drawing kit apparatus economically available to the buying public.

Still yet another object of the present invention is to provide a new and improved circle drawing kit apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
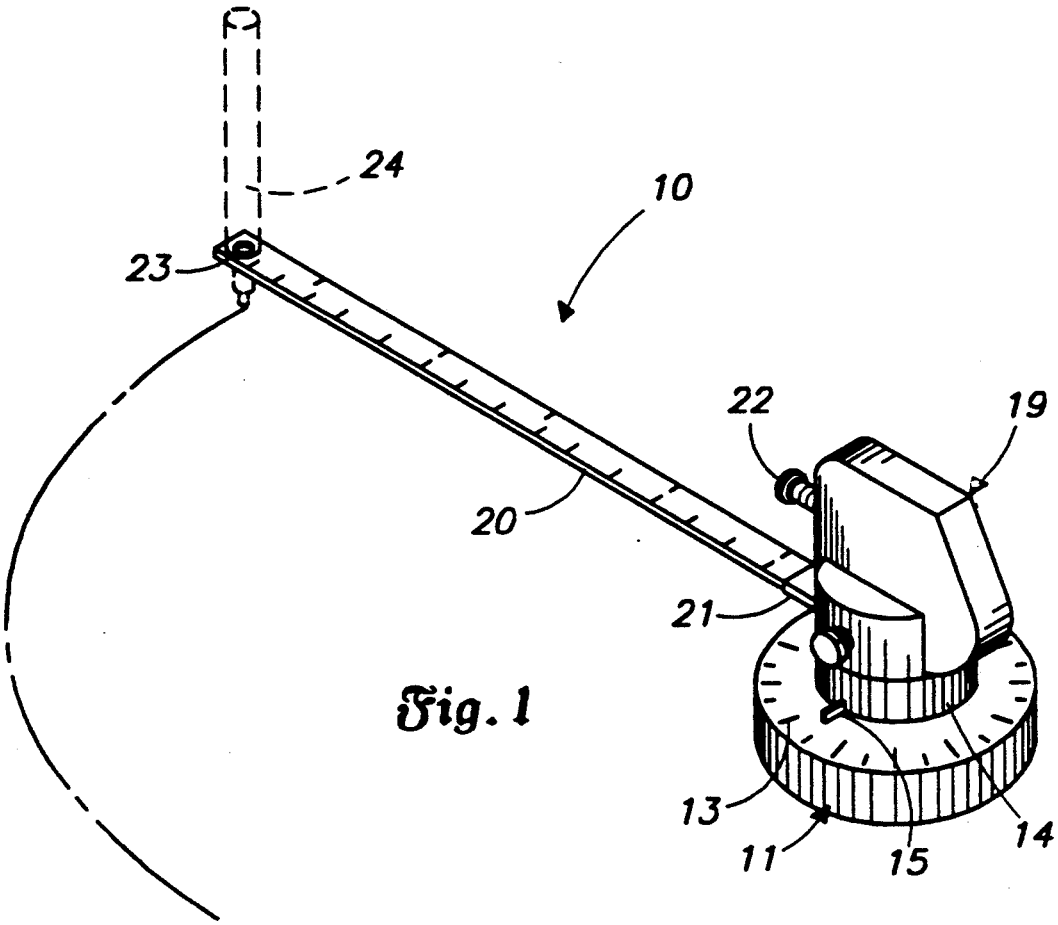
FIG. 1 is an isometric illustration of the instant invention.
Figure 2:
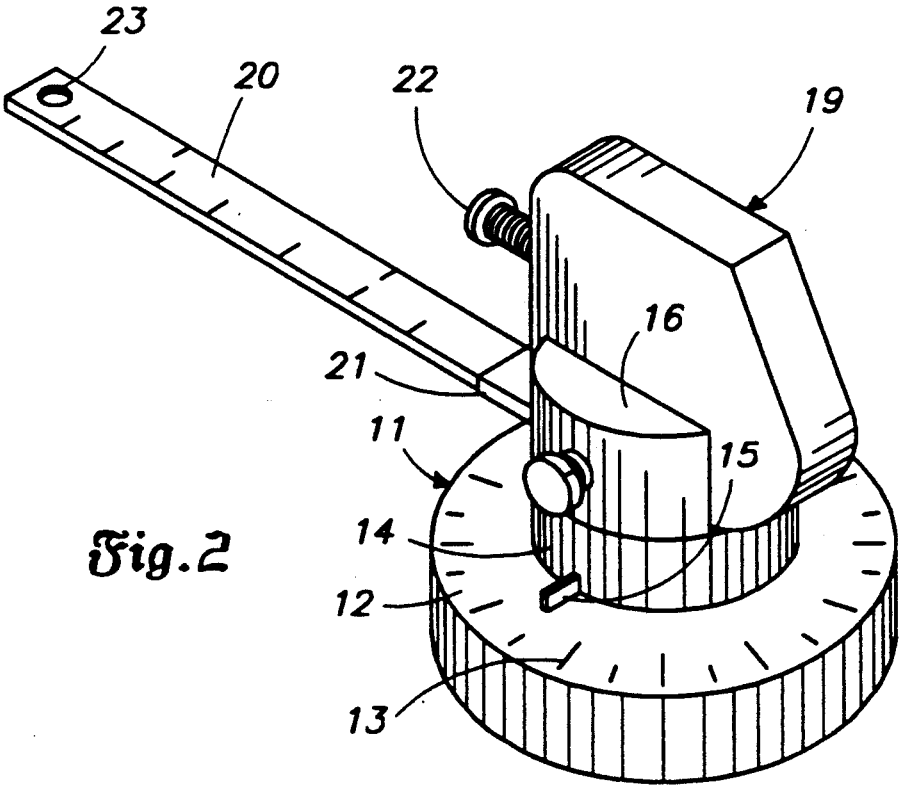
FIG. 2 is an isometric enlarged illustration of the instant invention.
Figure 3:
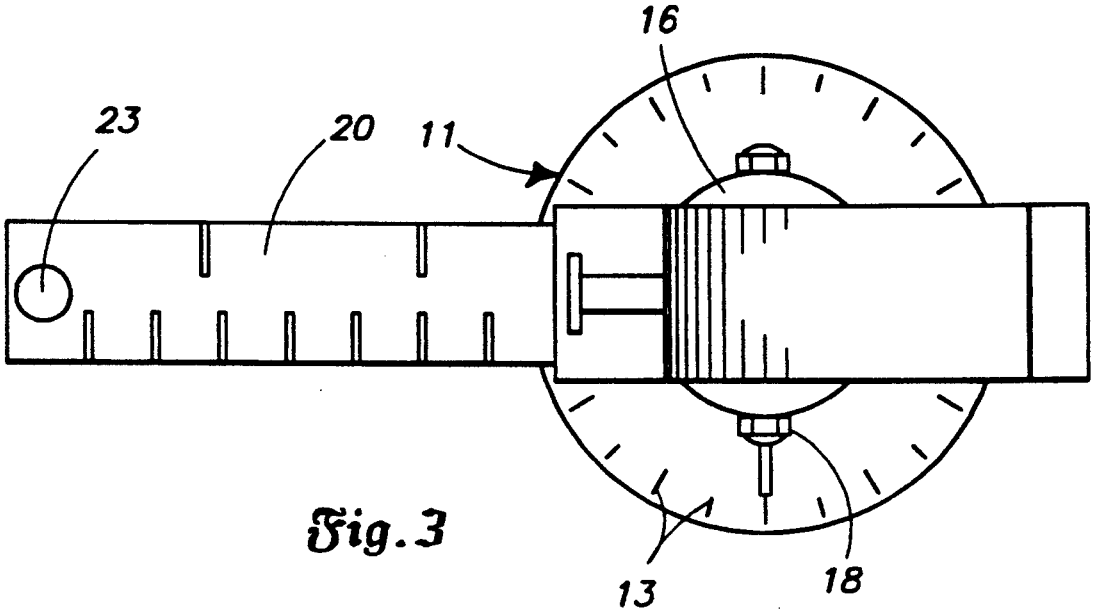
FIG. 3 is an orthographic top view of the instant invention.
Figure 4:
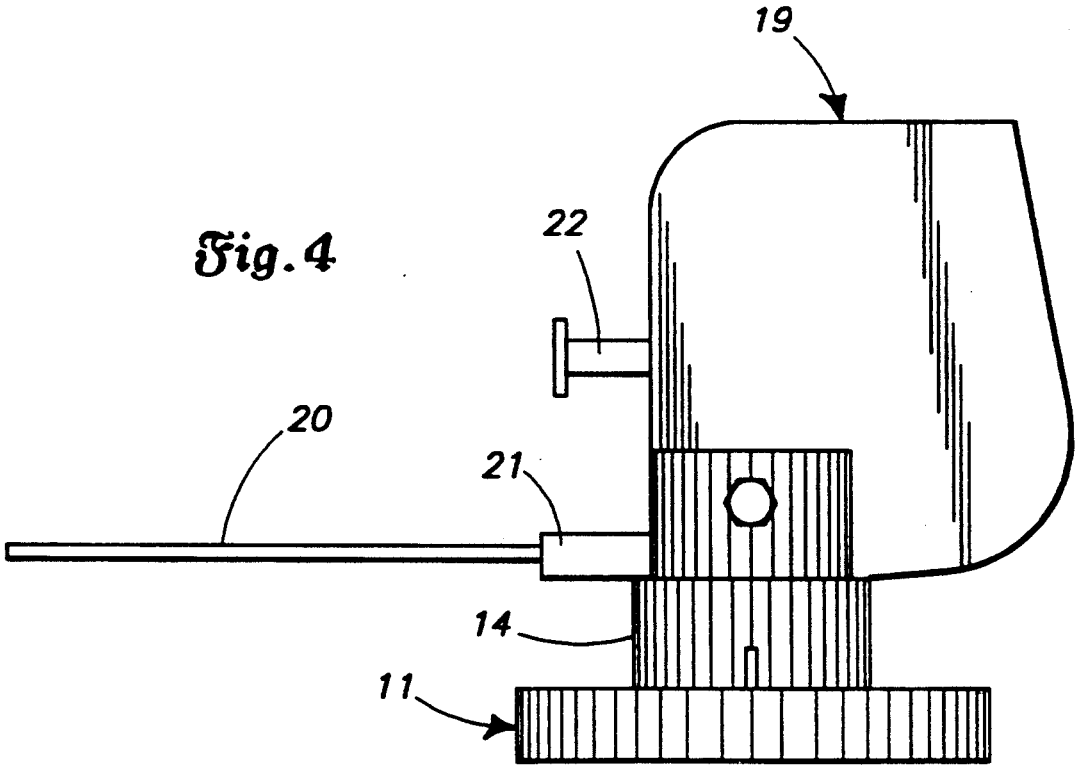
FIG. 4 is an orthographic side view of the instant invention.

With reference now to the drawings, and in particular to FIGS. 1 to 9 thereof, a new and improved circle drawing kit apparatus embodying the principles and concepts of the present invention and generally designated by the reference numeral 10 will be described.

More specifically, the circle drawing kit apparatus 10 of the instant invention essentially comprises the use of a ferromagnetic cylindrical base 11, including a planar top wall 12 formed with indicia 13 mounted about the periphery thereof for measuring degrees of arc relative to a circle to be scribed. A cylindrical mount 14 is coaxially and rotatably mounted to the planar top wall 12 relative to the base 11, including a rigid pointer arm 15 radially projecting exteriorly of the cylindrical mount 14 adjacent the top wall 12. A pivot axle 25 (see FIG. 5) is directed coaxially through the base 11 and rotatably mounted within the cylindrical mount 14.

Figure 5:
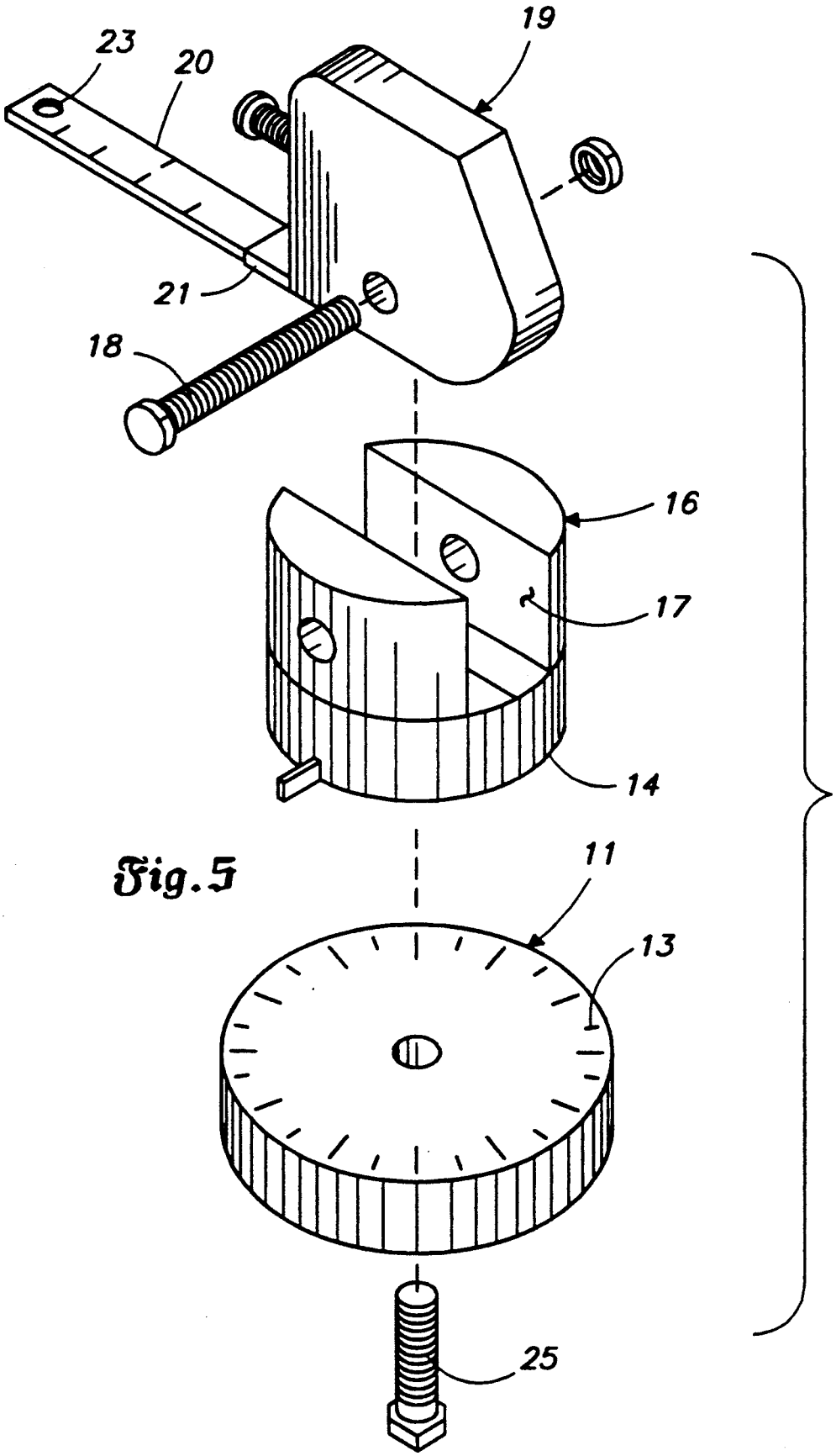
FIG. 5 is an isometric exploded illustration of the instant invention.
Figure 6:
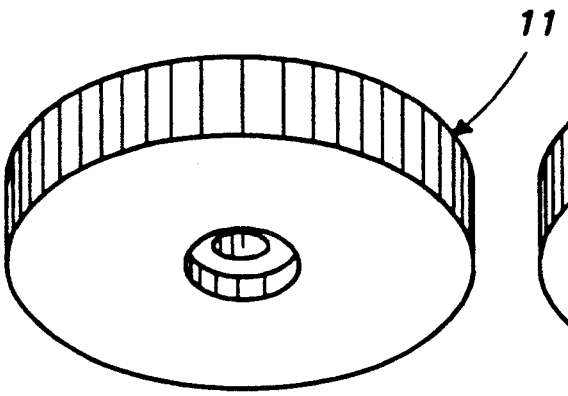
FIGS. 6, 7, 8, and 9 are isometric illustrations of various support bases utilized by the kit structure of the invention for selective securement to an associated cylindrical mount.
Figure 7:
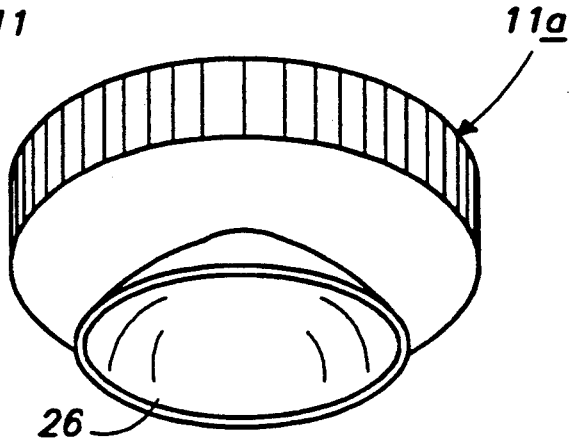
Figure 8:
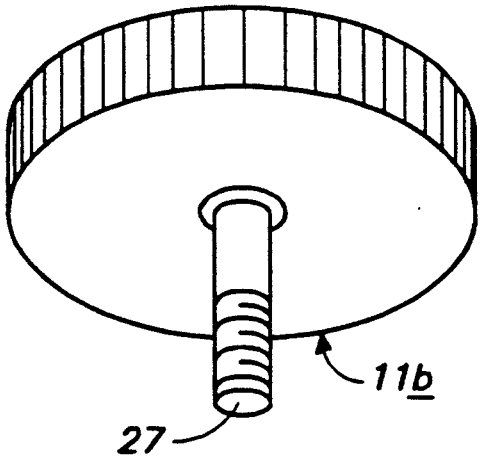
Figure 9:
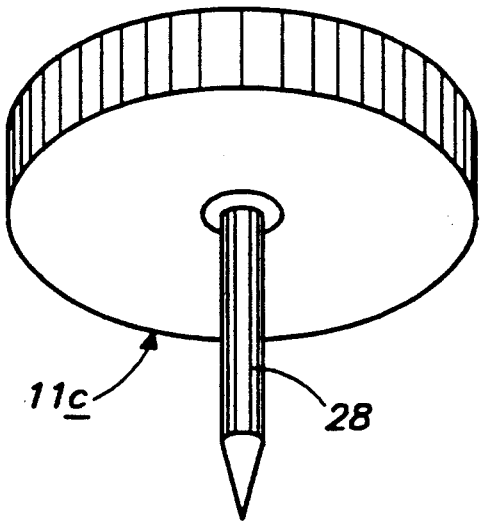

A bifurcated mounting head 16 is coaxially and fixedly secured to a top surface of the cylindrical mount 14 and includes confronting planar walls arranged in a parallel relationship relative to one another spaced apart a predetermined width defining the diametrically aligned slot 17, as illustrated in FIG. 5, to receive a lock pin 18 orthogonally relative to the planar confronting walls. A support reel housing 19 is fixedly mounted within the slot 17 and is defined by a width substantially equal to the predetermined width, and includes a feed conduit 21 arranged adjacent a floor of the slot 17 to project an extensible measuring web 20 therethrough. The measuring web 20 projects orthogonally relative to the confronting planar walls and the lock pin 18. The measuring web 20 includes a reel lock 22 projecting into the housing 19 to effect selective locking of the web 20 in an extended orientation relative to the housing 19. An aperture 23 is directed adjacent an outer distal end of the web 20 receiving a writing instrument 24 in an orthogonal relationship relative to and through the web 20 within the aperture 23 to provide for the scribing of a circular arc, as illustrated in FIG. 1.

The FIGS. 6–9 illustrate the bases 11*a*, 11*b*, and 11*c* respectively in association with the base 11 to provide for the use of a suction cup 26, a threaded boss 27, or a spike 28 to be utilized in lieu of the ferromagnetic base 11 to permit securement of the base and associated apparatus relative to various work surfaces to permit the scribing of a circular arc as required.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A circle drawing kit apparatus, comprising, a first cylindrical base formed of a ferromagnetic material, and the cylindrical base including a planar top wall, and the planar top wall including indicia formed on the planar top wall about the periphery of the top wall, and a cylindrical mount rotatably and coaxially mounted to the planar top wall, with the cylindrical mount including a support reel housing fixedly mounted to the cylindrical mount, the support reel housing including an extensible and retractable measuring web mounted retractably relative to the support reel housing, and including scribing means mounted adjacent a forward distal end of the measuring web for permitting scribing of a circular array to an underlying support surface, and the cylindrical mount includes a rigid pointer arm radially projecting exteriorly of the cylindrical mount adjacent the planar top wall and the indicia, and a bifurcated mount head fixedly secured to a top surface of the cylindrical mount, wherein the mount head includes a diametrically aligned slot including a floor directed through the mount head, with the slot defined at a predetermined width, and the support reel housing defined by a further width equal to the predetermined width contained within the slot, and a lock pin directed orthogonally through the slot and support reel housing to secure the support reel housing within the slot, and a feed conduit mounted to the support reel housing, wherein the feed conduit is longitudinally aligned relative to the slot to align the measuring web orthogonally relative to the lock pin, and a reel lock mounted to the support reel housing to permit selective securement of the web in a desired extended orientation relative to the housing, and the scribing means includes an aperture orthogonally directed through the web adjacent the forward distal end and including a writing instrument mounted within the aperture projecting below the web.

* * * * *